US011612263B2

(12) United States Patent
Root

(10) Patent No.: US 11,612,263 B2
(45) Date of Patent: Mar. 28, 2023

(54) OVEN APPLIANCE AND METHODS OF OPERATING DURING A RELIGIOUS HOLIDAY

(71) Applicant: Haier US Appliance Solutions, Inc., Wilmington, DE (US)

(72) Inventor: Steven Keith Root, Buckner, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 121 days.

(21) Appl. No.: 17/095,093

(22) Filed: Nov. 11, 2020

(65) Prior Publication Data

US 2022/0142389 A1 May 12, 2022

(51) Int. Cl.

| | |
|---|---|
| ***A47G 33/00*** | (2006.01) |
| ***F24C 7/08*** | (2006.01) |
| ***H05B 6/64*** | (2006.01) |
| ***H05B 1/02*** | (2006.01) |
| ***F24C 3/12*** | (2006.01) |

(52) U.S. Cl.

CPC ..... *A47G 33/00* (2013.01); *F24C 3/128* (2013.01); *F24C 7/085* (2013.01); *H05B 1/0263* (2013.01); *H05B 6/6447* (2013.01)

(58) Field of Classification Search

CPC ..... F24C 3/128; H05B 1/0263; H05B 6/6447

See application file for complete search history.

(56) References Cited

U.S. PATENT DOCUMENTS

| | | | | |
|---|---|---|---|---|
| 5,681,496 | A | 10/1997 | Brownlow et al. | |
| 5,791,890 | A | 8/1998 | Maugham | |
| 5,808,278 | A * | 9/1998 | Moon | G05B 19/0426 219/415 |
| 7,189,947 | B2 | 3/2007 | Fulton | |
| 8,669,501 | B2 | 3/2014 | Frommer | |
| 2007/0103887 | A1 * | 5/2007 | Bleier | H01H 13/18 219/391 |

(Continued)

FOREIGN PATENT DOCUMENTS

| | | |
|---|---|---|
| CA | 2632174 C | 4/2015 |
| EP | 2281419 B1 | 8/2012 |
| EP | 2063180 B1 | 10/2016 |

*Primary Examiner* — Thein S Tran

(74) *Attorney, Agent, or Firm* — Dority & Manning, P.A.

(57) ABSTRACT

An oven appliance may include a cabinet, a heating element, temperature sensor, and controller. The heating element may be within the cabinet to heat a cooking chamber. The temperature sensor may be mounted in thermal communication with the cooking chamber. The controller may be configured to initiate a cooking operation. The cooking operation may include directing the heating element according to a predetermined holiday heating cycle during a first holiday occurrence, collecting a plurality of temperature readings from the temperature sensor during the first holiday occurrence as a first temperature group, determining, following the first holiday occurrence, a temperature deviation from a set reference temperature, the temperature deviation being based on the first temperature group, generating a modified holiday heating cycle based on the determined temperature deviation, and directing the heating element according to the modified holiday heating cycle during a second holiday occurrence following the first holiday occurrence.

20 Claims, 3 Drawing Sheets

(56) References Cited

U.S. PATENT DOCUMENTS

| | | | | |
|---|---|---|---|---|
| 2009/0103907 | A1* | 4/2009 | Nave | F24D 19/1051 392/463 |
| 2012/0038478 | A1* | 2/2012 | Haviv | G08B 25/008 340/540 |
| 2012/0095614 | A1* | 4/2012 | DeLayo | F24H 9/2007 710/63 |
| 2016/0213187 | A1* | 7/2016 | Meusburger | H05B 1/0266 |
| 2016/0336123 | A1* | 11/2016 | Johncock | H01H 9/286 |
| 2017/0208650 | A1* | 7/2017 | Davis | F24C 15/26 |
| 2018/0245802 | A1* | 8/2018 | Tadmor | H05B 1/0244 |
| 2020/0037815 | A1* | 2/2020 | Farhamandfar | A47J 37/0629 |

* cited by examiner

OVEN APPLIANCE AND METHODS OF OPERATING DURING A RELIGIOUS HOLIDAY

FIELD OF THE INVENTION

The present subject matter relates generally to oven appliances, and more particularly to methods of operating oven appliances during a religious holiday, such as a Sabbath.

BACKGROUND OF THE INVENTION

Conventional residential and commercial oven appliances generally include a cabinet that defines a cooking chamber for receipt of food items for cooking. Heating elements are positioned within the cooking chamber to provide heat to food items located therein. The heating elements can include, for example, radiant heating elements, such as a bake heating assembly positioned at a bottom of the cooking chamber or a broil heating assembly positioned at a top of the cooking chamber.

Certain religious customs, such as Orthodox Jewish customs, require that certain traditions be maintained during designated times or holidays, which can influence how certain appliances, such as an oven appliance, may be used. For instance, the Sabbath (i.e., Shabbos or Shabbat) is set aside as a time when no work should be performed. This prohibition on work may apply not only to an observer's direct physical actions, but also to actions initiated through the observer's appliances. For instance, the observer may be required to abstain from causing an appliance to change its normal pattern of operation. In other words, a user may be prohibited from actions that would result in a direct response from the appliance, such as activating a heating element or heat-adjusting system. Nonetheless, many appliances are configured to provide this kind of direct response. In the field of oven appliances, heating elements are often activated according to a closed-loop algorithm to achieve or maintain a set temperature within the cooking chamber. Thus, a user opening the door to an oven appliance may influence when the heating elements to activate. Unfortunately, such actions may violate the sanctity of the day.

In order to properly observe certain religious holidays (e.g., Sabbath or other Orthodox Jewish customs), some appliances provide a method of manually disabling certain functions. Other appliances adjust functions to be more in line with religious law. For instance, features that normally (e.g., at times other than the Sabbath) operate according to a measured condition may be instead operated according to a set timer for the duration of the Sabbath. In the case of oven appliances, heating elements may be selectively turned on and off according to a basic timer or timed cycle. The on-off cycle may be developed by testing one or more representative units to maintain a predetermined temperature. Nonetheless, these existing approaches create certain difficulties or undesirable conditions. For instance, such approaches fail to account for variations in particular units or installation environments. Some units may heat faster or slower than the representative units used to develop the on-off cycle. Additionally or alternatively, variations in environment may affect the rate of heating. In particular, the available voltage from a municipal grid or energy density of gaseous fuels may be different in certain parts of the United States.

As a result, it would be useful to provide an oven appliance addressing one or more of the above-identified issues. In particular, it would be advantageous to provide an oven appliance or method of operation with features for holiday-compliant operation (e.g., while efficiently or effectively accounting for variations in a particular appliance unit or installed environment).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a heating element, a temperature sensor, and a controller. The cabinet may define a cooking chamber. The heating element may be within the cabinet to heat the cooking chamber. The temperature sensor may be mounted in thermal communication with the cooking chamber. The controller may be operably coupled to the heating element and the temperature sensor. The controller may be configured to initiate a cooking operation. The cooking operation may include directing the heating element according to a predetermined holiday heating cycle during a first holiday occurrence, collecting a plurality of temperature readings from the temperature sensor during the first holiday occurrence as a first temperature group, determining, following the first holiday occurrence, a temperature deviation from a set reference temperature, the temperature deviation being based on the first temperature group, generating a modified holiday heating cycle based on the determined temperature deviation, and directing the heating element according to the modified holiday heating cycle during a second holiday occurrence following the first holiday occurrence.

In another exemplary aspect of the present disclosure, a method of operating an oven appliance is provided. The method may include directing a heating element according to a predetermined holiday heating cycle during a first holiday occurrence and collecting a plurality of temperature readings from the cooking chamber during the first holiday occurrence as a first temperature group. The method may further include determining, following the first holiday occurrence, a temperature deviation from a set reference temperature, the temperature deviation being based on the first temperature group occurrence. The method may still further include generating a modified holiday heating cycle based on the determined temperature deviation and directing the heating element according to the modified holiday heating cycle during a second holiday occurrence following the first holiday occurrence.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
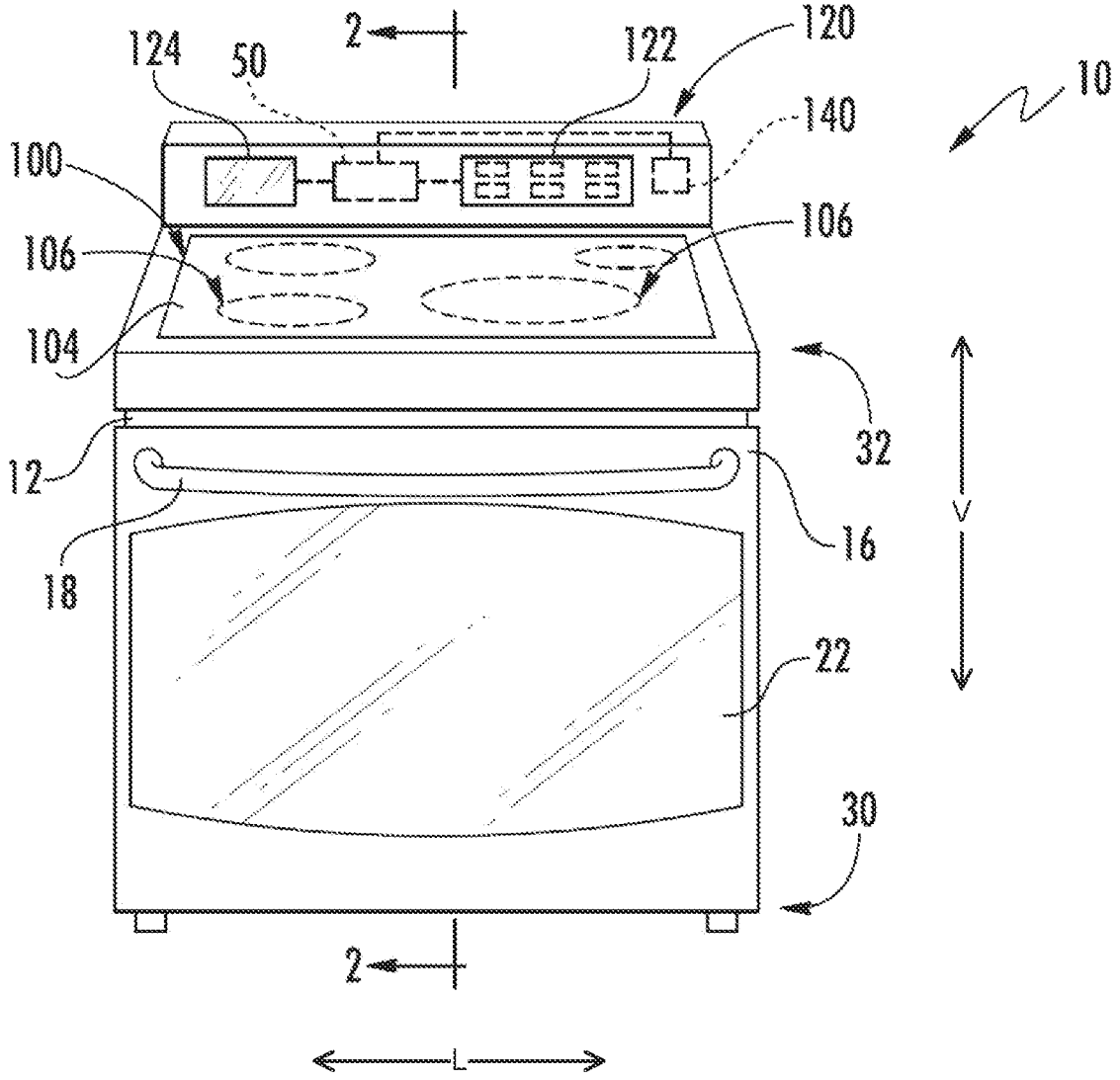
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
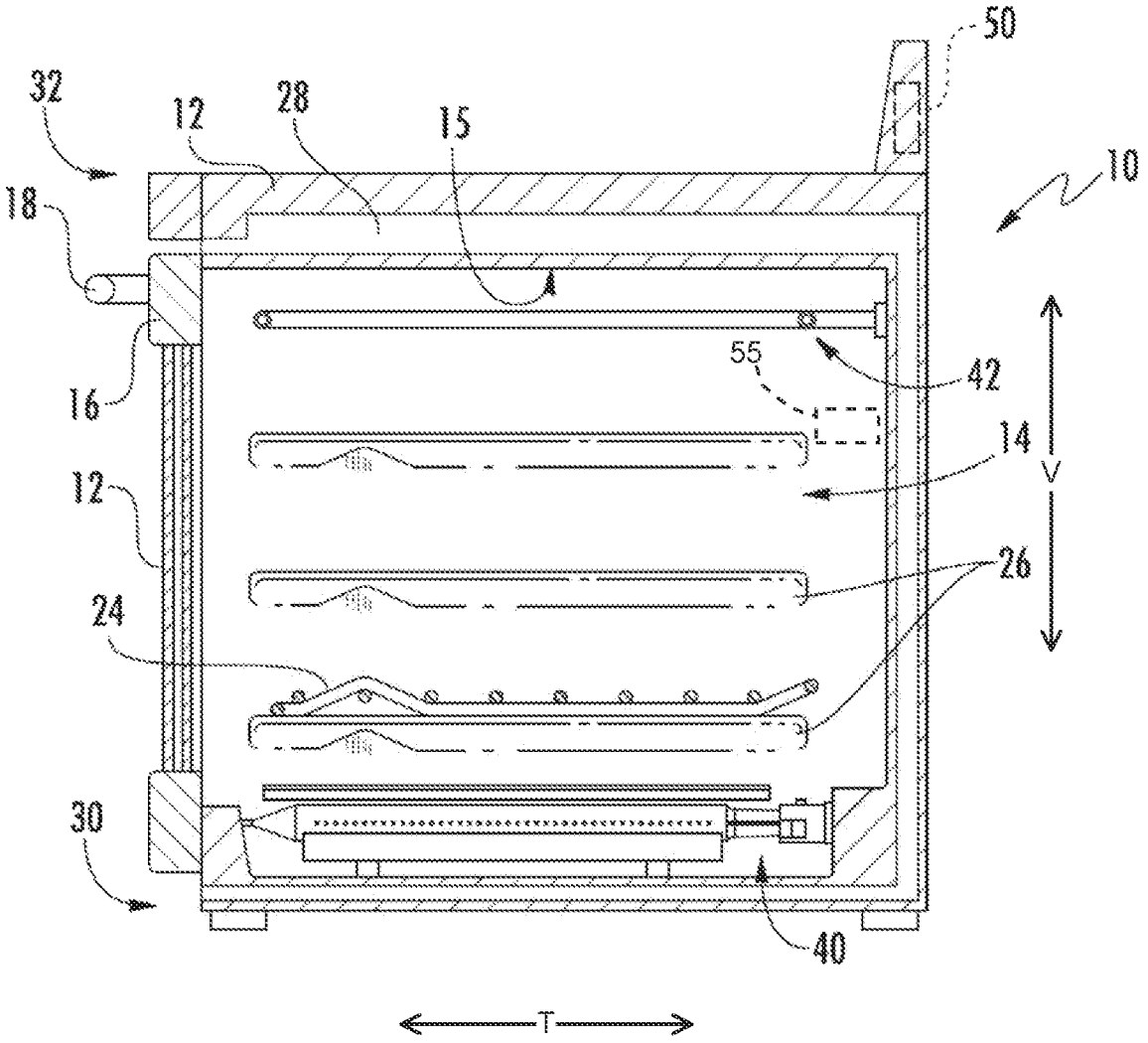
FIG. 2 provides a section view of the exemplary oven appliance of FIG. 1, taken along the line 2-2.

FIG. 1 provides a perspective view of an oven appliance 10 according to an exemplary embodiment of the present disclosure. FIG. 2 provides a section view of oven appliance 10 taken along the 2-2 line of FIG. 1. As may be seen, oven appliance 10 defines a vertical direction V, a lateral direction L and a transverse direction T. The vertical direction V, the lateral direction L and the transverse direction T are mutually perpendicular and form an orthogonal direction system. Oven appliance 10 is provided by way of example only and is not intended to limit the present subject matter in any aspect. Thus, the present subject matter may be used with other oven appliance configurations (e.g., that define one or more interior cavities for the receipt of food or having different pan or rack arrangements than what is shown in FIG. 2). Further, the present subject matter may be used in a stand-alone cooktop, range appliance, or any other suitable appliance.

Oven appliance 10 generally includes a cooking assembly. In particular, the cooking assembly may include one or more heating elements. For example, in some embodiments, the cooking assembly, and thus the oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12 (e.g., with a hinge—not shown). A handle 18 may be mounted to door 16 and assists a user with opening and closing door 16 in order to access cooking chamber 14. For example, a user can pull on handle 18 to open or close door 16 and access cooking chamber 14.

In some embodiments, oven appliance 10 includes a seal (not shown) between door 16 and cabinet 12 that assists with maintaining heat and cooking fumes within cooking chamber 14 when door 16 is closed as shown in FIG. 2. Multiple parallel glass panes 22 may provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

In certain embodiments, a gas fueled or electric bottom heating element 40 (e.g., a gas burner, a radiant heating element, microwave heating element, or a resistive heating element) is positioned in cabinet 12, for example, at a bottom portion 30 of cabinet 12. Bottom heating element 40 is used to heat cooking chamber 14 for both cooking and cleaning of oven appliance 10. The size and heat output of bottom heating element 40 can be selected based on, for example, the size of oven appliance 10.

In additional or alternative embodiments, a top heating element 42 (e.g., a gas burner, a radiant heating element, or a resistive heating element) is positioned in cooking chamber 14 of cabinet 12, for example, at a top portion 32 of cabinet 12. Top heating element 42 is used to heat cooking chamber 14 for both cooking/broiling and cleaning of oven appliance 10. Like bottom heating element 40, the size and heat output of top heating element 42 can be selected based on for example, the size of oven appliance 10.

As shown in FIG. 2, in certain embodiments, a cooling air flow passageway 28 can be provided within cabinet 12 between cooking chamber 14 and cooktop 100. For example, a portion of passageway 28 may be between cooking chamber 14 and cooktop 100 along a vertical direction V. Passageway 28 is shown schematically in the figures. As will be understood by one of skill in the art using the teachings disclosed herein, cooling air flow passageway 28 may have a variety of configurations other than as shown. Air flowing through passageway 28 can provide convective cooling.

In optional embodiments, the oven appliance 10 additionally includes a cooktop 100. Cooktop 100 may be disposed on the cabinet 12 such that the total volume of cabinet 12 is generally divided between the cooking chamber 14 and cooktop 100. As shown, cooktop 100 may include a top panel 104. By way of example, top panel 104 may be constructed of glass, ceramics, enameled steel, and combinations thereof. Heating assemblies 106 (e.g., induction heating elements, resistive heating elements, radiant heating elements, or gas burners) may be mounted, for example, on or below the top panel 104. While shown with four heating assemblies 106 in the exemplary embodiment of FIG. 1, cooktop appliance 100 may include any number of heating assemblies 106 in alternative exemplary embodiments. Heating assemblies 106 can also have various diameters. For example, each heating assembly of heating assemblies 106 can have a different diameter, the same diameter, or any suitable combination thereof.

As shown, oven appliance 10 includes a user interface panel 120, which may be located as shown, within convenient reach of a user of the oven appliance 10. User interface panel 120 is generally a component that allows a user to interact with the oven appliance 10 to, for example, turn various heating elements (such as heating elements 40, 42, 106) on and off, adjust the temperature of the heating elements, set built-in timers, etc. Although user interface panel 120 is shown mounted to a backsplash fixed to cabinet 12, alternative embodiments may provide user interface panel 120 at another suitable location (e.g., on a front portion of cabinet 12 above door 16).

In some embodiments, a user interface panel 120 may include one or more user-interface inputs 122 and a graphical display 124, which may be separate from or integrated with the user-interface inputs 122. The user-interface element 122 may include analog control elements (e.g., knobs, dials, or buttons) or digital control elements, such as a touchscreen comprising a plurality of elements thereon. Various commands for a user to select through the engagement with the user-interface inputs 122 may be displayed (e.g., by touchscreen at the inputs 122 or by the graphical display 124), and detection of the user selecting a specific command may be determined by the controller 50, which is in communication with the user-interface inputs 122, based on electrical signals therefrom. Additionally or alternatively, graphical display 124 may generally deliver certain information to the user, which may be based on user selections and interaction with the inputs 122, such as whether a one or more heating elements 40, 42 within cooking chamber 14 are activated, the temperature at which cooking chamber 14 is set, or whether a holiday mode (e.g., Sabbath mode) has been initiated. In certain embodiments, a discrete holiday mode input is included with the inputs 122. User engagement of the holiday mode input may activate the oven appliance 10 or initiate a particular cooking operation (e.g., such as method 300, described below with respect to FIG. 3).

Generally, oven appliance 10 includes a controller 50 that controls operation of the various components of the oven appliance 10. Controller 50 may include a memory (e.g., non-transitive media) and microprocessor, such as a general or special purpose microprocessor operable to execute programming instructions or micro-control code associated with a cleaning cycle. The memory may represent random access memory such RAM, ROM, EEPROM, EPROM, flash memory devices, magnetic disks, etc., and combinations thereof. The memory devices can store data and instructions that are executed by the processor to cause oven appliance 10 to perform various operations. For example, instructions could be instructions for directing activation of one or more of the heating elements 40, 42, such as may be provided according to one or more programmed cooking modes or operations (e.g., such as method 300, described below with respect to FIG. 3).

In some embodiments, controller 50 is in operable (e.g., wired or wireless) communication with a temperature sensor 55 (e.g., thermistor, thermocouple, etc.) disposed within cabinet 12 (e.g., within cooking chamber 14 or otherwise in thermal communication with cooking chamber 14) to detect a temperature at cooking chamber 14.

Figure 3:
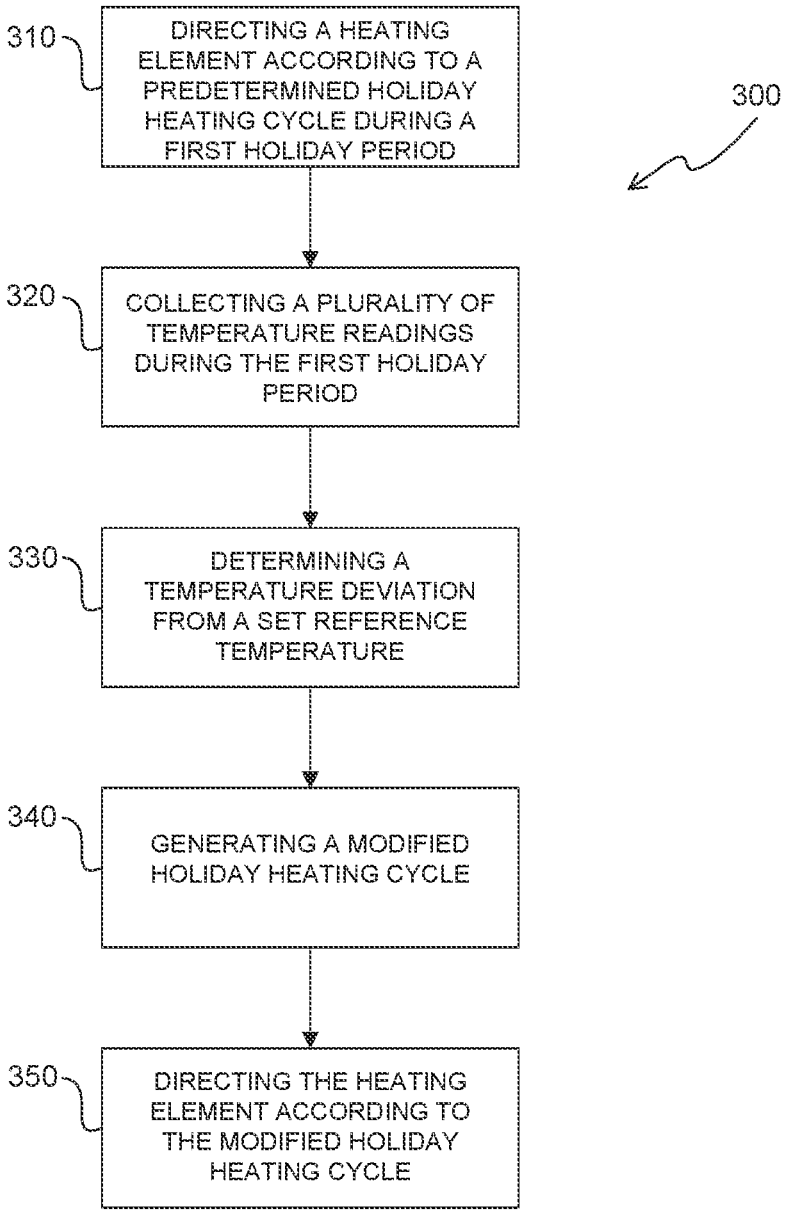
FIG. 3 provides a flow chart illustrating a method of operating an oven appliance according to exemplary embodiments of the present disclosure.

Turning now to FIG. 3, a flow chart is provided of method 300 according to example embodiments of the present disclosure. Generally, the method 300 provides for operating an oven appliance (e.g., oven appliance 10—FIG. 1), such as one including one more heating elements 40, 42 and temperature sensor 55, as described above. The method 300 can be performed, for instance, by the controller 50 (FIG. 1). For example, controller 50 may, as discussed, be in operable communication with heating elements 40, 42, temperature sensor 55, user interface panel 120, etc.

FIG. 3 depicts steps performed in a particular order for purpose of illustration and discussion. Those of ordinary skill in the art, using the disclosures provided herein, will understand that (except as otherwise indicated) the steps of the methods disclosed herein can be modified, adapted, rearranged, omitted, or expanded in various ways without deviating from the scope of the present disclosure.

Advantageously, methods within the scope of this disclosure may facilitate compliance with religious customs, such as Orthodox Jewish customs (e.g., while efficiently or effectively accounting for variations in a particular appliance unit or installed environment).

At 310, the method 300 includes directing the heating element according to a predetermined holiday heating cycle during a first holiday occurrence. In other words, for at least a portion of the first holiday occurrence, the heating element may be activated to generate heat within the cooking chamber as prescribed by the predetermined holiday heating cycle. Generally, the direction for or activation of heating element at 310 may attempt to maintain a preset temperature (e.g., programmed within controller or selected by a user prior to the first holiday) without directly responding to a temperature measurement of the cooking chamber during the first holiday occurrence. For instance, the predetermined holiday heating cycle may include or be provided as an open-loop duty cycle having a discrete active sub-period (e.g., during which the heating element is ignited or actively generating heat) and a discrete inactive sub-period (e.g., during which the heating element is not ignited or actively generating heat). As a non-limiting example, an active sub-period of ten seconds and an inactive sub-period of nine minutes, fifty seconds may be provided for the predetermined heating cycle. Thus, over the course of a ten-minute cycle interval, the heating element may only generate heat for ten seconds while being inactive for the remaining nine minutes, fifty seconds. As would be understood, the cycle may be repeated (e.g., over multiple ten-minute cycle intervals) for the duration of the first holiday occurrence or until the oven operation is otherwise halted (e.g., by a user or an emergency cutoff).

As described with respect to method 300, the heating element may include any suitable type or number of elements for heating food articles within cooking chamber. For instance, the heating element may include a top heating element or bottom heating element, as described above. Moreover, the heating element may include an electric heating element (e.g., a radiant heating element, microwave heating element, a resistive heating element, etc.) or gas burner.

Generally, the first holiday occurrence may correspond to any scheduled religious celebration or event, such as a Sabbath in accordance with Orthodox Jewish customs. The first holiday occurrence may be indicated (e.g., manually) by a user's selection of a holiday or Sabbath mode at the user interface. Alternatively, the first holiday occurrence may be determined automatically from a programmed clock or calendar maintained on the controller. Thus, a holiday start time and holiday end time may be determined for the first holiday occurrence. At the holiday start time, a holiday mode may be initiated (e.g., in place of a typical operating mode wherein a closed-loop heating cycle is permitted). Optionally, 310 may be initiated in response to or based on the holiday start time being met. Additionally or alternatively, 310 may be halted in response to or based on the holiday end time being met. As would be understood, 310 may also be halted manually by a user's selection at the user interface.

At 320, the method 300 includes collecting a plurality of temperature readings from the cooking chamber during the first holiday occurrence (e.g., while the predetermined holiday heating cycle is being executed). Generally, the plurality of temperature readings may be described or understood a as a first temperature group. Moreover, the plurality of temperature reading may be obtained at a common point (e.g., temperature sensor) at discrete points in time. Thus, the first temperature group may organize and record temperatures that actually occur as the heating element is being directed to heat the cooking chamber. Optionally, such temperature readings may be collected at a set collection interval (e.g., programmed in minutes) at a common temperature sensor.

At 330, the method 300 includes determining a temperature deviation from a set reference temperature based on the first temperature group. Specifically, 330 may occur after the completion of the first holiday occurrence. The set reference temperature may correspond to, for instance, a value programmed into the controller for the predetermined holiday heating cycle (e.g., for a holiday mode) or selected by a user prior to the first holiday occurrence.

Optionally, the deviation itself may be determined as a mean value. For instance, the mean value may calculated using an average of the first temperature group. Additionally or alternatively, multiple temperature groups (e.g., each corresponding to a discrete holiday occurrence) may be used to calculate the mean value. For instance, the mean value may be calculated as or using a running average of multiple past temperature groups. Optionally, the number of past temperature groups may be restricted to a set number of groups. The number may be set according to a programmed calendar interval (e.g., indicating the number of occurrences within a predetermined number of months, number of occurrences within one or more seasons, as a fixed number of sequential occurrences, etc.). Thus, if the appliance is regularly deviating from an intended operation, such a deviation may be indicated by a mean value that is greater than or less than the set reference temperature.

At 340, the method 300 includes generating a modified holiday heating cycle based on the determined temperature deviation. In particular, modified holiday heating cycle may have active and inactive sub-periods that differ from the active and inactive sub-periods of the predetermined holiday heating cycle (e.g., over a cycle interval that is identical in both the modified and predetermined holiday heating cycles). As an example, if it is determined that the temperature deviation is greater than the set reference temperature at 330, the modified heating cycle may have an active sub-period that is less than the active sub-period of the predetermined heating cycle (e.g., less than fifty seconds). By contrast, if it is determined that the temperature deviation is less than the set reference temperature at 330, the modified heating cycle may have an active sub-period that is greater than the active sub-period of the predetermined heating cycle (e.g., greater than fifty seconds). The magnitude or amount of a modifier (i.e., increase/decrease) of the active sub-period for the modified heating cycle may be determined, for instance, according to a proportional-integral-derivative (PID) control loop, as would be understood.

In optional embodiments, the magnitude or amount of increase/decrease of the active sub-period for the modified heating cycle may be effectively limited.

As an example, the magnitude or amount of increase in the active sub-period between sequential holiday occurrences may be limited by a set percentage. In some such embodiments, the active sub-period of the modified holiday heating cycle may be limited to being within 10% of the active sub-period of the predetermined holiday heating cycle. Thus, if the PID control loop calculates a modifier that has an absolute value that is more than 10% of the active sub-period of the predetermined holiday heating cycle, the modifier may be reduced to 10% of the active sub-period of the predetermined holiday heating cycle. In other words, the modified heating cycle may have an active sub-period that is between 90% and 110% of the active sub-period of the predetermined holiday heating cycle.

As an additional or alternative example, the magnitude or amount of increase in the active sub-period may be limited to a set range having a minimum time and a maximum time (e.g., programmed within the controller). In other words, the active sub-period of the modified holiday heating cycle may be required to be at least greater than or equal to the minimum time and less than or equal to the maximum time. For instance, if the PID control loop calculates a modifier would decrease the active sub-period of the modified holiday heating cycle below the minimum time, the active sub-period of the modified holiday heating cycle may be set as the minimum time. Similarly, if the PID control loop calculates a modifier would increase the active sub-period of the modified holiday heating cycle above the maximum time, the active sub-period of the modified holiday heating cycle may be set as the maximum time.

At 350, the method 300 includes directing the heating element according to the modified holiday heating cycle during a second holiday occurrence, which follows the first holiday occurrence as a separate or discrete holiday occurrence (e.g., as the sequentially-subsequent holiday occurrence, such as the next Sabbath that occurs after the first Sabbath). For at least a portion of the second holiday occurrence, the heating element may be activated to generate heat within the cooking chamber as prescribed by the modified holiday heating cycle.

Generally, the direction for, or activation of, heating element at 350 may attempt to maintain the preset temperature (e.g., as described above) without directly responding to a temperature measurement of the cooking chamber during the second holiday occurrence. Thus, the modified holiday heating cycle may include or be provided as an open-loop duty cycle having the determined active and inactive sub-periods. As would be understood, the cycle may be repeated (e.g., at discrete cycle intervals) for the duration of the second holiday occurrence or until the oven operation is otherwise halted (e.g., by a user or an emergency cutoff).

Although described in the context of a first and second holiday occurrence, it is understood that the above steps may be repeated to determine and apply a new modified holiday heating cycle using the previous modified heating cycle in place of the predetermined holiday heating cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a cooking chamber;

a heating element within the cabinet to heat the cooking chamber;

a temperature sensor mounted in thermal communication with the cooking chamber; and a controller operably coupled to the heating element and the temperature sensor, the controller being configured to initiate a cooking operation comprising directing the heating element according to a predetermined holiday heating cycle during a first holiday occurrence, collecting a plurality of temperature readings from the temperature sensor during the first holiday occurrence as a first temperature group, determining, following the first holiday occurrence, a temperature deviation from a set reference temperature, the temperature deviation being based on the first temperature group, generating a modified holiday heating cycle based on the determined temperature deviation, and directing the heating element according to the modified holiday heating cycle during a second holiday occurrence following the first holiday occurrence.

2. The oven appliance of claim 1, wherein the predetermined holiday heating cycle comprises an open-loop duty cycle comprising a discrete active sub-period and inactive sub-period for the heating element, and wherein the modified holiday heating cycle comprises an open-loop duty cycle comprising a discrete active sub-period and inactive sub-period for the heating element.

3. The oven appliance of claim 2, wherein the active sub-period of the modified holiday heating cycle is limited to being within 10% of the active sub-period of the predetermined holiday heating cycle.

4. The oven appliance of claim 2, wherein the active sub-period of the modified holiday heating cycle is limited to being within a set range having a minimum time and a maximum time.

5. The oven appliance of claim 1, wherein the heating element comprises an electric heating element.

6. The oven appliance of claim 1, wherein the heating element comprises a gas burner.

7. The oven appliance of claim 1, wherein the first and second holiday occurrences are discrete Sabbaths.

8. The oven appliance of claim 1, wherein determining the temperature deviation comprises determining an average of the first temperature group.

9. The oven appliance of claim 8, wherein determining the temperature deviation comprises determining a running average of a plurality of temperature groups each corresponding to a discrete holiday occurrence, the first temperature group being one temperature group of the plurality of temperature groups.

10. The oven appliance of claim 9, wherein the plurality of temperature groups is restricted to a set number of groups according to a programmed calendar interval.

11. A method of operating an oven appliance comprising a plurality of chamber walls mounted within a cabinet and defining a cooking chamber, a controller, and a heating element operably coupled to the controller and mounted within the cabinet to heat the cooking chamber, the method comprising:

directing, using the controller, the heating element according to a predetermined holiday heating cycle during a first holiday occurrence;

collecting a plurality of temperature readings from the cooking chamber during the first holiday occurrence as a first temperature group;

determining, following the first holiday occurrence, a temperature deviation from a set reference temperature, the temperature deviation being based on the first temperature group;

generating a modified holiday heating cycle based on the determined temperature deviation; and directing, using the controller, the heating element according to the modified holiday heating cycle during a second holiday occurrence following the first holiday occurrence.

12. The method of claim 11, wherein the predetermined holiday heating cycle comprises an open-loop duty cycle comprising a discrete active sub-period and inactive sub-period for the heating element, and wherein the modified holiday heating cycle comprises an open-loop duty cycle comprising a discrete active sub-period and inactive sub-period for the heating element.

13. The method of claim 12, wherein the active sub-period of the modified holiday heating cycle is limited to being within 10% of the active sub-period of the predetermined holiday heating cycle.

14. The method of claim 12, wherein the active sub-period of the modified holiday heating cycle is limited to being within a set range having a minimum time and a maximum time.

15. The method of claim 11, wherein the heating element comprises an electric heating element.

16. The method of claim 11, wherein the heating element comprises a gas burner.

17. The method of claim 11, wherein the first and second holiday occurrences are discrete Sabbaths.

18. The method of claim 11, wherein determining the temperature deviation comprises determining an average of the first temperature group.

19. The method of claim 18, wherein determining the temperature deviation comprises determining a running average of a plurality of temperature groups each corresponding to a discrete holiday occurrence, the first temperature group being one temperature group of the plurality of temperature groups.

20. The method of claim 19, wherein the plurality of temperature groups is restricted to a set number of groups according to a programmed calendar interval.

* * * * *